US010598168B2

(12) United States Patent
Schulze et al.

(10) Patent No.: US 10,598,168 B2
(45) Date of Patent: Mar. 24, 2020

(54) ENGINE COMPRESSOR UNIT

(71) Applicants: Rudolf Schulze, Berlin (DE); Detlev Kils-Korte, Hamburg (DE)

(72) Inventors: Rudolf Schulze, Berlin (DE); Detlev Kils-Korte, Hamburg (DE)

( * ) Notice: Subject to any disclaimer, the term of this patent is extended or adjusted under 35 U.S.C. 154(b) by 412 days.

(21) Appl. No.: 15/446,167

(22) Filed: Mar. 1, 2017

(65) Prior Publication Data

US 2017/0254320 A1 Sep. 7, 2017

(30) Foreign Application Priority Data

Mar. 1, 2016 (DE) ..... 10 2016 103 615

(51) Int. Cl.

| | |
|---|---|
| ***F04B 35/00*** | (2006.01) |
| ***F02B 63/06*** | (2006.01) |
| ***F04B 27/06*** | (2006.01) |
| ***F02B 57/08*** | (2006.01) |
| ***F01B 13/06*** | (2006.01) |
| ***F04B 27/047*** | (2006.01) |
| ***F04B 27/053*** | (2006.01) |

(52) U.S. Cl.

CPC ..... *F04B 35/002* (2013.01); *F01B 13/068* (2013.01); *F02B 57/08* (2013.01); *F02B 63/06* (2013.01); *F04B 27/0472* (2013.01); *F04B 27/053* (2013.01); *F04B 27/065* (2013.01); *F04B 27/0657* (2013.01)

(58) Field of Classification Search

CPC .. F04B 35/002; F04B 27/0472; F04B 27/065; F04B 27/0657; F04B 27/053; F01B 13/068; F02B 57/08; F02B 63/06

See application file for complete search history.

(56) References Cited

U.S. PATENT DOCUMENTS 1,285,835 A * 11/1918 Sunderman ..... F01B 13/045 123/43 R
1,557,395 A * 10/1925 Augustine ..... F02B 57/08 123/44 C
1,586,775 A * 6/1926 Bowman ..... F01B 1/0624 91/325
1,729,548 A * 9/1929 Price ..... F04B 27/0428 417/555.1
1,732,147 A * 10/1929 Augustine ..... F01B 13/068 123/44 C (Continued)

FOREIGN PATENT DOCUMENTS

DE 4300264 A1 7/1994

*Primary Examiner* — Christopher S Bobish
(74) *Attorney, Agent, or Firm* — Von Rohrscheidt Patents

(57) ABSTRACT

An engine compressor unit including at least one rotary engine; and at least one rotary compressor for compressing at least one gaseous fluid; the rotary engine including an engine housing including at least one engine ring that is rotatably supported in the engine housing about an engine axis, at least one engine cylinder that is arranged in the engine ring, wherein an engine piston is arranged in the at least one engine cylinder so that the engine piston defines a combustion chamber of the at least one engine cylinder together with a wall of the at least one engine cylinder, wherein the engine piston is supported in the at least one engine cylinder by an engine connecting rod so that the engine piston is movable in the at least one engine cylinder in a linear manner.

11 Claims, 7 Drawing Sheets

(56) References Cited

U.S. PATENT DOCUMENTS

| | | | | | |
|---|---|---|---|---|---|
| 1,742,706 | A * | 1/1930 | Hermann | F02B 57/08 | 123/44 R |
| 1,968,694 | A * | 7/1934 | Leibing | F01B 7/18 | 123/44 C |
| 1,981,481 | A * | 11/1934 | Tursky | F04B 27/0409 | 417/462 |
| 2,073,547 | A * | 3/1937 | Berry | F04B 27/0465 | 417/270 |
| 2,123,391 | A * | 7/1938 | Whitfield | F04B 27/0446 | 91/495 |
| 2,661,699 | A * | 12/1953 | Smith | F01B 1/0624 | 74/25 |
| 3,274,946 | A * | 9/1966 | Simmons | F01B 1/0644 | 91/486 |
| 3,477,415 | A * | 11/1969 | Wyssbrod | F02B 57/08 | 123/44 C |
| 3,605,564 | A * | 9/1971 | Shoemaker | F01B 13/068 | 91/495 |
| 4,073,216 | A * | 2/1978 | Davis | F01B 1/0624 | 123/44 R |
| 5,228,294 | A * | 7/1993 | Murray | F01B 13/061 | 60/709 |
| 5,524,577 | A * | 6/1996 | Clifford | F01B 13/061 | 123/44 D |
| 8,894,384 | B1 * | 11/2014 | Konrad | F01B 1/062 | 417/273 |
| 9,447,725 | B2 * | 9/2016 | Okada | F04B 35/06 | |
| 2018/0335232 | A1 * | 11/2018 | Swab | F25B 27/00 | |

* cited by examiner

ENGINE COMPRESSOR UNIT

RELATED APPLICATIONS

This application claims priority from and incorporates by reference German Patent Application DE 10 2016 103 615.3 filed on Mar. 3, 2016.

FIELD OF THE INVENTION

The instant invention relates to an engine compressor unit including a rotary engine and a rotary compressor. The rotary engine and the rotary compressor are coupled with each other so that the rotary compressor is drivable by the rotary engine. Thus, a torque transmission is performed between the rotary engine and the rotary compressor. In particular the engine compressor unit can include an input shaft-/output shaft which is connected with the rotary engine and with the rotary compressor.

The invention furthermore relates to a rotary engine, including:

an engine housing including at least one engine ring that is rotatably supported in the engine housing about an engine axis of the engine housing, at least one cylinder that is arranged in the engine ring, wherein an engine piston is arranged in the cylinder which piston defines a combustion chamber of the cylinder together with a wall of the cylinder, wherein the engine piston is supported at a connecting rod so that the engine piston is moveable in the cylinder in a linear manner, and at least one engine piston axis about which the engine piston is rotatable so that the engine piston moves on a circular path during operation of the rotary engine, wherein the piston axis is oriented parallel to the engine axis and arranged offset from the engine axis so that the at least one engine piston performs a cyclic up and down movement within the cylinder during a rotation of the engine ring about the engine axis, wherein the cylinder includes at least one valve arrangement which facilitates introducing media into the combustion chamber of the cylinder and/or letting the media out of the combustion chamber of the cylinder during the operation of the rotary engine, An offset of the piston axis from the engine axis is also designated as eccentricity. The up and down movement of the engine pistons within the associated cylinders is caused by the fact that the engine piston and the engine ring respectively rotate about different rotation axes, namely the engine ring rotates about the engine axis and the engine pistons rotate about the piston axis. The engine ring as well as the engine pistons respectively rotate on a circular path during operation of the rotary engine.

BACKGROUND OF THE INVENTION

Units including a drive, in particular an engine as well as a compressor are already known in the art. Reference is made for example to US patent application 2007/017236 3A1. This application relates to an engine compressor unit where a drive that is not specified in more detail cooperates with an axial compressor. The engine compressor unit is characterized in that it is arranged in a common housing. This housing shields the known engine compressor unit relative to an ambient. The cited document relates to a particular routing of air compressed by the compressor, wherein at least a portion of the compressed air shall be used for cooling the drive.

The German publication document DE 43 00 264 A1 relates to an engine compressor unit where a drive unit and a compressor unit are respectively configured as rotation machines which are designated as rotating piston units. As can be derived from the document the rotation axes of the respective units are arranged parallel to one another and offset from each other on top of each other. The operating principle of the known engine compressor unit is based on a central transmission bolt which establishes a force transmission between the engine and the compressor.

A rotary engine of the general type described supra can also be derived from U.S. Pat. No. 1,968,694. This patent shows a rotary engine that includes an engine ring with a plurality of cylinders and a corresponding number of engine pistons, wherein the engine pistons are respectively linked by a connecting rod at a common connecting rod disc. The connecting rod disc rotates about a piston axis which is offset from the engine axis of the rotary engine by an eccentricity. In the known rotary engine in particular controlling the valves of the individual cylinders is particularly complex.

BRIEF SUMMARY OF THE INVENTION

It is an object of the invention to provide an engine compressor unit which is operable in particular without electrical current wherein a simple rotary engine shall be advantageously used.

The object is achieved by an engine compressor unit which is configured as follows.

The rotary engine includes an engine housing including at least one engine ring that is rotatably supported in the engine housing. The engine housing is supported so that it is rotatable about an engine axis of the engine housing. Within the engine ring at least one cylinder, advantageously a plurality of cylinders is arranged, wherein a respective engine piston is arranged in each of the cylinders. An engine piston defines a combustion chamber together with a wall of a respective cylinder wherein the engine piston is movably supported in a linear manner along a center axis of the respective cylinder within the respective cylinder. Put differently a volume of the compressor chamber is variable by a movement of the engine piston along a cylinder axis. The at least one engine piston is respectively supported by a connecting rod, wherein the engine pistons are supported overall so that they are rotatable about a piston axis. The rotation of the at least one engine piston is performed so that the at least one engine pistons orbits on a circular path about the piston axis. The piston axis is oriented parallel to the engine axis and offset therefrom. Put differently the piston axis is arranged eccentrical to the engine axis. This has the effect that the engine ring and the engine pistons rotate about different axes or orbit on different circular paths. Thus, the engine pistons perform the described up and down movement within their cylinders of the engine ring.

The rotary compressor includes a compressor housing with at least one compressor ring that is rotatably supported in the compressor housing wherein the compressor ring is rotatably supported about a compressor axis of the compressor housing. The compressor ring includes at least one cylinder wherein a compressor piston is arranged in the at least one cylinder. The compressor piston defines a compressor chamber together a wall of the cylinder, wherein the compressor piston is supported movable in a linear direction in the cylinder of the compressor ring. The compressor piston is connected by a connecting rod at least indirectly with a piston axis of the rotary compressor so that the compressor piston orbits on a circular path about the piston axis during operation of the rotary compressor. The piston axis is arranged parallel to the compressor axis and offset from the compressor axis by an eccentricity. While the compressor ring rotates about the compressor axis and the compressor piston rotates as described about the piston axis a continuous relative motion occurs between the compressor piston and the respectively associated cylinder during operation of the rotary compressor in analogy to the previously described rotary engine which causes an up and down movement of the compressor piston in the cylinders.

The rotary engine and the rotary compressor are coupled with each other in a torque transmitting manner by a transmission device. Typically the coupling occurs so that a speed of the rotary engine is directly transmitted to the rotary compressor so that the rotary compressor rotates with the same speed around the compressor axis. By the same token it is also conceivable that the transmission device includes a transmission which allows a different rotation of the rotary engine in the rotary compressor. In particular it is conceivable that a speed ratio between rotary engine and rotary compressor is variable.

The engine compressor unit according to the invention has the particular advantage that it is operable independently from electrical power. Thus, the rotary engine is suited in particular to combust suitable fuels and to drive the rotary compressor in this manner. Put differently the rotary engine converts chemical energy into mechanical energy. By coupling the rotary engine to the rotary compressor and the occurring combination and the resulting combination forming the engine compressor unit the rotary compressor can be operated. Fuels for the rotary engine can be all suitable materials like natural gas, gasoline or diesel fuel. Combining a compressor with an internal compressor engine has the advantage that the compressor can be operated independently from an electrical power supply. This can be advantageous in particular in areas that are not supplied with electrical power. In particular it is conceivable to operate a compression refrigeration machine with the engine compressor unit according to the invention. This way the compressor refrigeration machine can deliver cooling power off the grid.

Advantageously the rotary engine is operated as a two stroke engine. This means that each of the pistons performs two strokes between two sequential ignitions in the associated cylinder. This type of operation of the rotary engine is particularly simple compared to four stroke operations and improves a service life of the rotary engine.

Advantageously the rotary engine and the rotary compressor of the engine compressor unit according to the invention are arranged along a common axis, wherein the engine axis of the rotary engine and the compressor axis of the rotary compressor coincide. This common axis of the engine compressor unit simultaneously forms a transmission axis of the transmission device by which the rotary engine and the rotary compressor are connected with each other. The arrangement of the rotary engine and the rotary compressor directly adjacent to each other or above each other is particularly advantageously with respect to torque proof coupling of the two rotary machines since merely a rigid connection between the engine ring and the compressor ring has to be generated.

In an advantageous embodiment of the engine compressor unit the transmission device is configured coupleable so that a transmission of a torque between the rotary engine and the rotary compressor is optionally activate able or de activate able. It is conceivable in particular to operate the engine compressor unit with a plurality of rotary engines and/or rotary compressors, wherein advantageously individual rotary engines or individual compressors are couple able or decouple able. Providing a coupling facilitates in particular to operate only portions of the engine compressor unit which are actually required for a respective application.

In a particularly advantageous embodiment of the engine compressor unit according to the invention the rotary engine and/or the rotary compressor are supported by a stationary crank shaft. Advantageously, the rotary engine and the rotary compressor are supported at a common stationary crank shaft. The crank shaft or a shaft axis of the crank shaft is thus arranged so that the engine ring or the compressor ring rotate about the crank shaft or the shaft axis. Put differently the shaft axis of the crank shaft advantageously coincides with the engine axis or the compressor axis. Therefore the piston axes of the rotary engine or of the rotary compressor have to be offset from the shaft axis of the crank shaft by the eccentricity. Thus, the crank shaft has at least one elbow wherein the elbow includes the respective piston axis. Ideally the crank shaft is only formed by individual plates or pins which can be joined without particular technical complexity. In the portion of the elbow or the elbows the crank shaft includes plates whose diameter exceeds the diameter of the actual shaft, wherein pins are arranged in a radially outer portion of the plates and parallel to the shaft axis. The engine pistons of the rotary engine or the compressor pistons of the rotary compressor can then rotate about the fixated eccentricity about the crank pins of the crank shaft which generates the eccentrical rotation between the engine ring and the compressor ring and the respectively associated pistons.

Depending which type of operation is provided for the rotary compressor it can be advantageous to arrange respective elbows along the crank shaft offset relative to each other so to speak by a phase angle when using a common crank shaft for the rotary engine and the rotary compressor so that the piston axis of the rotary engine does not coincide with the piston axis of the rotary compressor. In this case the engine compressor unit would include a total of three essential rotation axes, namely the shaft axis of the crank shaft which simultaneously includes the engine axis of the rotary engine and the compressor axis of the rotary compressor, the piston axis of the rotary engine and the piston axis of the rotary compressor. These axes are respectively arranged parallel to one another and offset from each other.

In a particularly advantageous embodiment of the engine compressor unit compressor the rotary engine and/or the rotary compressor are respectively supported in an associated housing, the rotary engine in an engine housing and the rotary compressor in a compressor housing. A rise extends on an inner enveloping surface of the respective housing in a radial direction over a partial angle range relative to the engine axis or the compressor axis. The rise is configured so that a maximum elevation of the rise measured to the respective rotation axis of the respective rotary machine has a smaller radial distance than the remaining portions of the respective housing outside of the rise. This geometric ratio is subsequently described with reference to an embodiment.

With reference to an embodiment of the rotary engine a respective engine housing with a recess has the particular advantage that the rise can be used for mechanically controlling a valve arrangement of a cylinder of the rotary engine. This is based on the idea that a valve control can be provided in a particularly simple manner by two mechanical forces, namely on the one hand side a centrifugal force caused by the rotation of the rotary engine and on the other hand side an axial force which is transmitted by a transmission element. The transmission element is in turn configured to transfer an axial force for example onto an associated valve plate or another valve element of the engine ring wherein the axial force is oriented in the radial direction of the rotary engine.

Outside of the rise described supra a valve arrangement of this type including a respective valve head is pressed into its valve seat due to the centrifugal force, so that the combustion chamber of a respective cylinder is sealed tight relative to its ambient. In the portion of the rise at an inner enveloping surface of the engine housing, however, the valve arrangement is forced to perform a relative movement relative to the engine ring viewed in a radial direction relative to the engine axis in that a transmission element that cooperates with the rise has to move in a radial direction due to the form locking between the valve arrangement and the rise wherein the rise extends in the radial direction. Thus, a lift off force can be imparted upon the respective valve element of the valve arrangement in the radial direction wherein the lift off force lifts the valve head from its valve seat. Thus, the combustion chamber of the cylinder of the rotary engine is flow connected with its environment so that for example exhaust gases can be run out of the combustion chamber. Since the rise extends only over a partial angular range of the engine housing the described type of engagement of the valve arrangement with the rise only occurs over the partial angular range. Outside of the partial angular range the valve arrangement including the valve head is pressed into the valve seat of the cylinder by centrifugal forces. When designing the valve train an engineer is at liberty to provide one or plural rises along the circumference of the engine housing and to determine their arc length relative to the engine axis. This way the valve train of the associated rotary engine is adjustable according to an individual application at will solely by changing a position of a rise and its geometry.

In order to transition the valve arrangement between an open position and a closed position therefore no spring element and no particular drive device or similar is required. Accordingly a valve train of this type is very robust and independent from an electrical supply, for example independent from a complex control system or similar. Accordingly it is possible to operate the rotary engine with a particularly high speed above 10,000 rpm which is not possible in the prior art due to a limited performance of valve springs which are used for closing the valves. The described centrifugal force control operates without assistance of this type. It can only be required for a start-up phase of the rotary engine to provide a respective valve spring since sufficient centrifugal forces may not yet impact the valve arrangement. A valve spring of this type however does not perform any function during an operating phase of the rotary engine.

In an advantageous embodiment an associated valve arrangement includes a support element, in particular a running roller or a running slide by which the valve arrangement is supported at the inner enveloping surface of the engine housing. Advantageously the inner enveloping surface in turn includes a corresponding support element, for example configured as a support groove or support rail, this way the valve arrangement is safely supported along a constant track curve of the engine housing and run over the rise during every revolution so that the valve is cyclically opened and then closed again due to the acting centrifugal forces. It is also conceivable as a matter of principle to run the support element of the valve arrangement over the rise of the engine housing only for every second revolution and to facilitate four stroke operations of the rotary engine in this manner. In this case the guide element of the engine housing has to be configured accordingly so that the guide element of the engine ring is only run over the rise for every second revolution and thus an opening of the respective valve is caused.

In case the compressor housing as well as the engine housing respectively include a rise of the type recited supra it can be particularly advantageous to arrange the compressor housing and the engine housing offset from each other relative to the transmission axis of the engine compressor unit, in particular opposite to each other. This is based on the consideration that the rise is used for opening a valve or the associated valve arrangement. When the rotary engine is coupled with the rotary compressor there is the option to use the rotary compressor for supercharging the rotary engine, this means so to speak as a supercharger. For this application it is required that the valves of the rotary engine and the rotary compressor open at different points in time on their orbit about the transmission axis. The valve arrangements of the rotary engine open in order to release exhaust gas from the respectively associated cylinders, whereas opening the valve of the rotary compressor is used to let the compressed gas out the respective cylinder. In case the compressed gas is intended to be introduced into the combustion chamber of a respective cylinder of the rotary engine it is appreciated that the valve arrangement of the rotary engine should be closed when the compressed gas is introduced whereas the valve arrangement of the rotary compressor has to be open. Therefore the described offset of the rises is particularly useful in this case.

The described opposite arrangement of the rises relative to the transmission axis of the engine compressor unit is particular advantageous when the engine compressor unit or at least the rotary engine thereof is operated in two stroke operation.

In a particular advantageous embodiment of the engine compressor unit according to the invention the rotary engine and the rotary compressor are combined in a common engine compressor housing. An engine compressor housing of this type includes the engine housing of the rotary engine as well as the compressor housing of the rotary compressor. The engine compressor unit thus configured forms a uniform component viewed from the outside wherein advantageously the engine compressor housing has a uniform diameter and thus a constant outer diameter along its longitudinal axis. Thus, it is particularly advantageous when the engine ring of the rotary engine and the compressor ring of the rotary compressor have at least essentially identical dimension, advantageously completely identical dimensions. This also applies to a number of cylinders of the rotary engine and of the rotary compressor. Advantageously the rotary engine as well as the rotary compressor have an identical number of cylinders which advantageously correspond to each other, this means are arranged without offset from each other relative to the transmission axis or the engine axis or the compressor axis. A respective configuration can be derived for example from the subsequently described embodiment.

It can be advantageous for a particularly efficient operation of the engine compressor unit according to the invention when at least one supercharger tube is provided which is configured to establish a flow connection between a gas outlet opening of the rotary compressor and a gas inlet opening of the rotary engine. A supercharger tube of this type can be used to conduct a compressed gas from a respective cylinder of the rotary compressor to the corresponding cylinder of the rotary engine. In this embodiment the rotary compressor operates at least partially, advantageously entirely as a supercharger for the rotary engine. Supercharging the rotary engine facilitates increasing its performance.

In an advantageous embodiment the cylinders of the rotary engine and the rotary compressor are associated with each other wherein they are arranged relative to the transmission axis only with a small angular offset or 20° at the most, advantageously 10° at the most, more advantageously completely without any offset. Put differently the cylinders of the rotary engine and the rotary compressor are advantageously arranged along an axis of the engine compressor unit in direct alignment behind each other or slightly rotated relative to each other. With an arrangement of this type it is particularly simple to install the described supercharger tube since it can be arranged directly between the cylinders of the rotary engine and the rotary compressor that correspond with each other. In particular a supercharger tube of this type can be configured completely straight, this means over its longitudinal axis without kinks, curves, or other deflections. Ideally the rotary engine as well as the rotary compressor are operated with the same speed so that the supercharger tube or the supercharger tubes can be permanently connected with their associated cylinders. Thus, advantageously the rotary engine and the rotary compressor are respectively configured with the same number of cylinders. Advantageously a respective cylinder of the rotary compressor is associated with a respective cylinder of the rotary engine, wherein a respective cylinder pair is flow connected by the supercharger tube.

It is a particular advantage of the describe invention including the at least one supercharger tube that the supercharger tube due it its rotation is continuously cooled together with the rotary engine and the rotary compressor. A temperature problem that is associated in the prior art with known turbochargers can thus be avoided. This is also helped by a straight, this means a non-cambered embodiment of the supercharger tube.

As an additional variant of the engine compressor unit according to the invention it can be advantageous to expand it with a generator unit. A generator unit of this type is configured to convert mechanical energy into electrical energy wherein the generator unit includes at least one generator housing in which a rotor is supported rotatable about a generator shaft. The generator shaft has to be at least temporarily coupleable in a force transferring manner with the transmission device so that a drive torque of the rotary engine is transferrable to the generator unit.

Thus, it is conceivable as a matter of principle to decouple the rotary engine of the engine compressor unit and to operate the generator with electrical power as an electric motor and provide a torque transferring connection between the electric motor and the rotary compressor. This way the rotary compressor can be optionally operated with electrical power that means by the electric motor. The generator shaft would in this case operate as a drive shaft. Thus, it is certainly conceivable to establish a torque transmitting connection between a generator of this type or the electric motor with the rotary compressor or the engine compressor unit with another type of torque transmission device so that an input shaft and output shaft is not necessarily required.

When a generator unit is provided it is advantageous to arrange the rotary engine between the rotary compressor and the generator unit, wherein the rotation axes of the rotary engine, the rotary compressor and the generator unit advantageously are identical.

Furthermore it can be advantageous when providing a generator unit to configure the generator housing as part of a common housing, thus of an entire housing. In this embodiment the engine compressor unit as such and the generator unit are joined in a common housing and form a unit.

Improving upon a rotary engine of the general type described supra the object is achieved in that the valve arrangement engages the engine housing in a form locking manner at least over a partial angular portion of a complete revolution of the cylinder about the engine axis, wherein at least one valve element of the valve arrangement is liftable from its valve seat through the engagement so that a flow connection is releasable or released between the combustion chamber of the cylinder and its ambient. The advantage of this embodiment is already described supra. In particular it is possible to control the valve devices of the rotary engine purely mechanically, wherein opening and closing the valves is done without additional components. In particular no spring elements or similar is required. Instead the valve arrangements are controlled only by centrifugal forces occurring during operation of the rotary engine and by the engagement of the valve arrangement at the engine housing.

An engagement of the valve arrangement at the engine housing can be performed in a particular simple manner by a rise which extends at least over a partial angular range of a complete revolution of the cylinder about the engine axis on an inner enveloping surface of the engine housing. As described supra this rise is typically a radially extending profile thickness increase of the engine housing, wherein a radially measured distance between a peak of the rise and the engine axis is smaller than a radially measured distance between the inner surface of the engine housing outside of the rise and the engine axis.

The rise is configured to force a valve arrangement of the rotary engine radially inward wherein for example a valve head of the valve arrangement is lifted from its valve seat at the respectively associated cylinder of the rotary engine. This opens the valve of the cylinder.

Outside of the rise the valve head is pressed back into its valve seat and the valve is closed.

The mechanical implementation of a valve control by the rise described supra can be implemented in a particularly simple manner by a support groove or a support rail, wherein the support groove or the support rail is arranged circumferentially closed at the inner enveloping surface of the engine housing and runs so to speak over the rise, this means it cooperates with the rise. The valve arrangement can be supported in the support groove or on the support rail. This way the valve arrangement is forced during each rotation of the rotary engine to engage the rise and to cause an opening of the valve.

In another particularly advantageous embodiment the valve arrangement interacts with a running roller or a support slide through which the valve arrangement can interact with the described support rail.

In a particularly advantageously embodiment the engine compressor unit according to the invention can cooperate with the compression refrigeration machine. A compression refrigeration machine of this type includes at least one expansion unit, a compressor unit which is integrated together with the expansion unit in a flow cycle and at least two heat exchangers which are flow connected on both sides between the compressor unit and the expansion unit. The compressor unit of the compression refrigeration machine can be formed by at least one rotary compressor of the engine compressor unit according to the invention.

Thus, it is conceivable in principle that an engine compressor unit includes plural rotary compressors wherein for example one of the rotary compressors is configured as a supercharger for the rotary engine and the other rotary compressor acts as a compressor unit for a compression refrigeration machine. It is also conceivable to configure the engine compressor unit according to the invention with plural rotary engines which are combinable with each other so that a power of the engine compressor unit is adjustable in increments.

The compression refrigeration machine according to the invention can be operated in particular without being connected to an electrical power grid. Since the rotary engine eventually drives the rotary compressor as a part of the engine compressor unit which rotary compressor drives the refrigeration cycle of the compression refrigeration machine. A compression refrigeration machine of this type is also usable in areas where electrical grid power is not available at all or is at least rather insecure and unstable.

BRIEF DESCRIPTION OF THE DRAWINGS

The rotary engine according to the invention is subsequently described in more detail with based on an embodiment with reference to drawing figures, wherein.

DETAILED DESCRIPTION OF THE INVENTION

Figure 1:
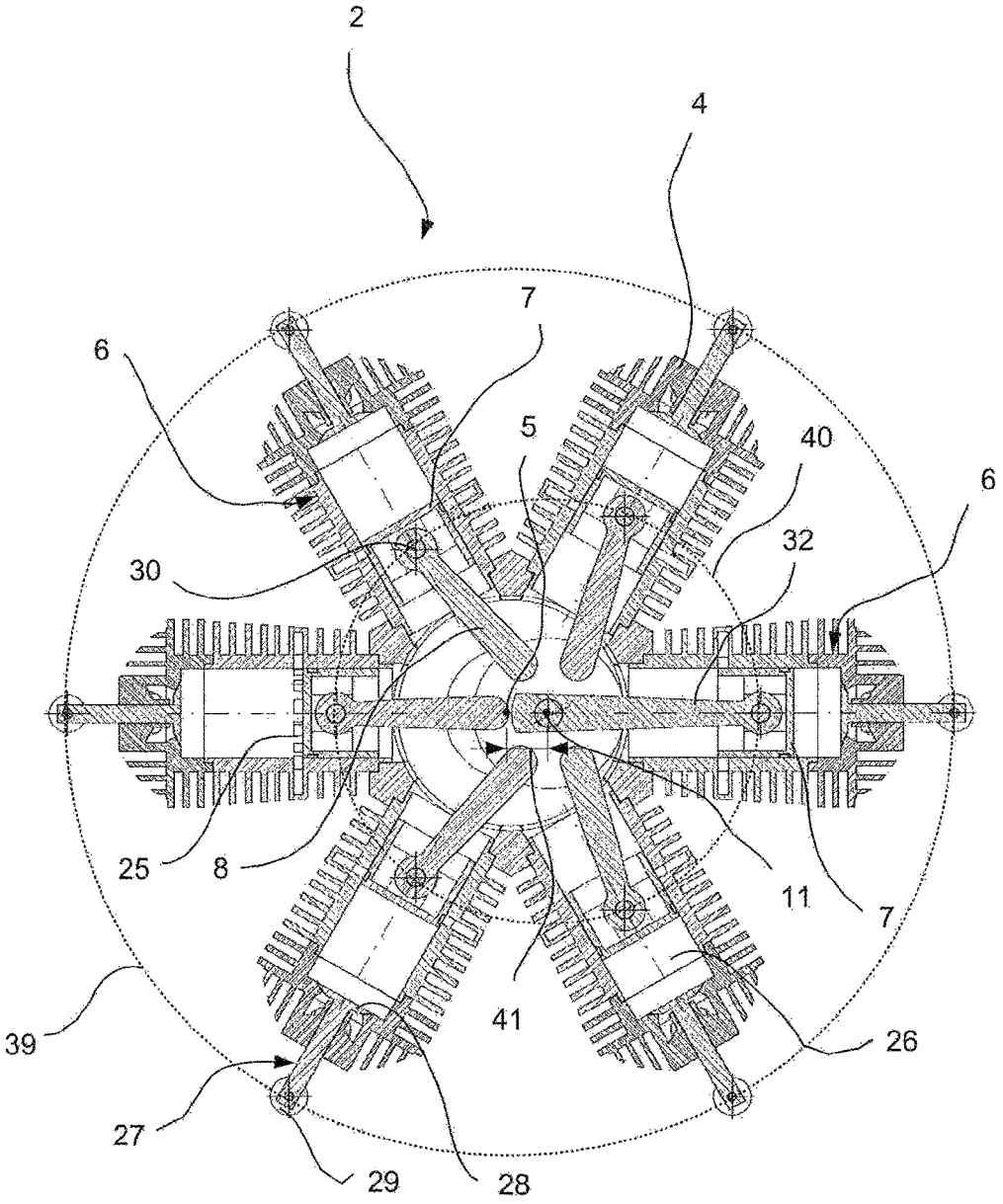
FIG. 1 illustrates a cross section through a rotary engine of an engine compressor unit according to the invention.

The embodiment illustrated in FIGS. 1-7 includes an engine compressor unit 1 according to the invention that is formed by a rotary engine 2 according to the invention and a rotary compressor 3. The rotary engine 2 and the rotary compressor 3 are coupled with one another in a force transferring manner by a transmission device 10. The transmission device 10 in the instant embodiment is made from a coupling arrangement which is formed by a plurality of rods which are oriented parallel to a transmission axis 9 of the engine compressor unit 1.

The rotary engine 2 and the rotary compressor 3 are essentially configured identical. The rotary engine 2 includes an engine ring 4 which includes in this case a total of six cylinders 6. Within the cylinders 6 of the rotary engine 2 a respective engine piston 7 is supported linear moveable. An engine piston 7 and a respective associated cylinder 6 and its outer wall jointly define a combustion chamber 26 in which a combustion of a fuel, for example natural gas or gasoline occurs during an operation of the rotary engine 2. The individual engine pistons 7 are respectively connected by a connecting rod 8 with a connecting rod disc 34 in a force transferring manner. A respective connecting rod 8 is coupled by a piston link 30 with the respectively associated engine pistons 7. The piston links 30 facilitate rotating the connecting rods 8 relative to the associated engine piston 7. The rotating movement between the connecting rod 8 and the engine piston 7 is performed about a link axis of the piston link 30. In addition to the regular connecting rods 8 each of the connecting rod discs 34 is furthermore connected with a master connecting rod 32. The master connecting rod 32 is connected torque proof with the connecting rod disc 34. The master connecting rod 32 is also connected in a non-pivotable manner with the associated engine piston 7 so that a rotation of the engine piston 7 relative to the master connecting rod 32 is blocked.

During operation of the rotary engine 2 the engine ring 4 rotates about an engine axis 5. The rotation of the engine ring 4 is predetermined by the kinematics of the rotary engine 2 as will be described in more detail infra.

As already described supra the instant rotary engine 2 includes a total of six cylinders 6 and consequently six engine pistons 7 and six connecting rods 8, 32. All connecting rods 8 of the rotary engine 2 are coupled to the same connecting rod disc 34. The individual connecting rods 8 are thus arranged in one plane and are not arranged offset from each other along the engine axis 5. During a rotation of the engine ring 4 one of the cylinders 6 or the associated master connecting rod 32 performs a guide function. The master connecting rod 32 is connected torque proof at a center of the connecting rod disc 34.

The center of the connecting rod disc 34 is arranged on a piston axis 11 of the rotary engine 2. The piston axis 11 describes an axis about which the engine pistons 7 orbit during the rotation of the engine ring 4. An associated circular path 40 is illustrated in FIG. 1. The piston axis 11 is oriented parallel to the engine axis 5 of the rotary engine 2 and offset relative to the engine axis 5 by an eccentricity 41. The eccentricity 41 between the engine axis 5 and the piston axis 11 causes a linear stroke movement of the engine pistons 7 within the cylinders 6 to be converted into a rotating movement of the engine ring 4 during operation of the rotary engine 2. This principle is known under the designation "rotary engine". In order to impart a torque upon the connecting rod plate 34 the individual connecting rods 8 are not aligned parallel to a connecting axis of the piston axis 11 and the respective piston link 30 of the respective engine piston 7 but pivoted relative to the this connection axis. This applies for all connecting rods 8 besides the master connecting rod 32 which is coupled directly in a straight line with the piston axis 11. This arrangement is necessary to reduce a degree of freedom of the connecting rod plate 34 from a number of 2 to a number of 1 and to force the individual engine pistons 7 to move on their circular path 40.

The rotary compressor 3 has a configuration that is identical in principle to the rotary engine 2. In the illustrated embodiment the rotary compressor 3 also includes six cylinders 14 which are arranged in a compressor ring 12 of the rotary compressor 3. Within the cylinders 14 of the rotary compressor 3 compressor pistons 15 are supported in a linear moveably manner. The compressor pistons 15 are in turn connected by a connecting rod 16 at a connecting rod disc 34 which is a separate connecting rod disc. Put differently the connecting rods 8 of the rotary engine 2 and the connecting rods 16 of the rotary compressor 3 are arranged at different connecting rod discs 34. Also the rotary compressor includes a master connecting rod 32.

The illustrated rotary engine 2 is operated as a two stroke engine, wherein the associated engine piston 7 performs two strokes within the cylinder 6 during a full revolution of a cylinder 6 of the rotary engine 2 by 360° about the engine axis 5. In the position of the rotary engine 2 illustrated in FIG. 1 the right cylinder 6 is in an ignition position in which the engine piston 7 is arranged in an upper reversal position. In this upper reversal position of the engine piston 7 the combustion chamber 26 of the cylinder 6 has a minimum volume. During a complete revolution of the cylinder 6 or the engine ring 4 about the engine axis 5 the engine piston 7 is rotated about the piston axis 11 once completely and thus moved from its upper reversal position into its lower reversal position and back again. The lower reversal position of an engine piston 7 is shown for the cylinder 6 that is illustrated on a left side of FIG. 1.

Two stroke operations of the rotary engine 2 have the effect that a respective ignition occurs per revolution of the engine ring 4 in each other cylinder 6. Thus, it is irrelevant as a matter of principle whether the ignition is performed by a spark plug, for example in a gasoline engine, or self-acting, e.g. in a diesel engine. During a revolution of a respective cylinder 6 about the piston axis 5 the cylinder 6 or its combustion chamber 26 is emptied and recharged completely.

In the illustrated embodiment charging can be performed in a particularly simple manner by a gas inlet opening 25, wherein each other cylinder 26 respectively includes one gas inlet opening. The gas inlet openings 25 are arranged at the cylinders 6 so that they are only released when the respective engine piston 7 is arranged in its lower reversal position. This position of a respective engine piston 7 is particularly advantageous for filling the combustion chamber 26 since the engine piston 7 moves back towards its upper reversal position after the lower reversal position so that a volume of the combustion chamber 26 is continuously reduced. The reduction of the volume of the combustion chamber 26 leads to a compression of the gas arranged in the combustion chamber and therefore to a significant pressure rise in the combustion chamber 26. This provides combustion conditions for a next ignition when the engine piston 7 is provided in its upper reversal position.

The engine compressor unit 1 according to the invention has a peculiar feature in the illustrated embodiment. For starters the rotary engine 2 as well as the rotary compressor 3 are respectively configured with an identical number of cylinders 6, 14. Furthermore the cylinders 6, 14 are respectively arranged in pairs. This means that each of the cylinders 6 of the rotary engine 2 corresponds to a cylinder 14 of the rotary compressor 3 so that they do not have any angular offset relative to the engine axis 5 or the compressor axis 13 or the transmission axis 9. Put differently the individual cylinders 6, 14 are arranged along the transmission axis 9 of the engine compressor unit without an offset behind one another or in alignment with each other. Due to the torque proof coupling of the engine ring 4 with the compressor ring 12 the relative alignment of the cylinders 6, 14 with each other remains constant during the operation of the engine compressor unit 1.

This embodiment facilitates to flow connect the rotary compressor 3 and the rotary engine 2 with one another through supercharger tubes 23. This embodiment is based on the idea to use the rotary compressor 3 so to speak as a supercharger for the rotary engine 2. For this purpose the rotary compressor 3 respectively includes a gas outlet opening 24 at its cylinders 14 or at outer ends of the cylinders 14 that are oriented away from the gas outlet opening 24. The gas outlet opening 24 is used for conducting gas that has been compressed by the rotary compressor 3 from the associated compression chamber of the respective cylinder 14. The gas thus compressed can now be conducted by the respectively associated supercharger tube 23 directly to the corresponding gas inlet opening 25 of the associated cylinder 6 of the rotary engine 2. This configuration facilitates to supercharge the rotary engine 2 and thus significantly improve efficiency of the rotary engine 2. For connecting the supercharger tubes 23 to the respectively corresponding cylinders 6, 14 of the rotary engine 2 and the rotary compressor 3 it is not required that the cylinders 6, 14 are arranged exactly without offset relative to the transmission axis 9, however this configuration is advantageous in order to be able to connect the supercharger tubes 23 in a simpler manner.

The supercharger tubes 23 are respectively configured by a straight tube element, wherein a deflection of gas flowing through a supercharger tube 23 does not occur. The supercharger tubes 23 have a variable cross section over their axial length.

In a particularly advantageous embodiment of the engine compressor unit 1 an atomized or gaseous fuel can be introduced into a respective supercharger tube 23 so that filling a combustion chamber 26 of an associated cylinder 6 of the rotary engine 2 is performed using the gas flow of the gas compressed by the rotary compressor 3.

Figure 2:
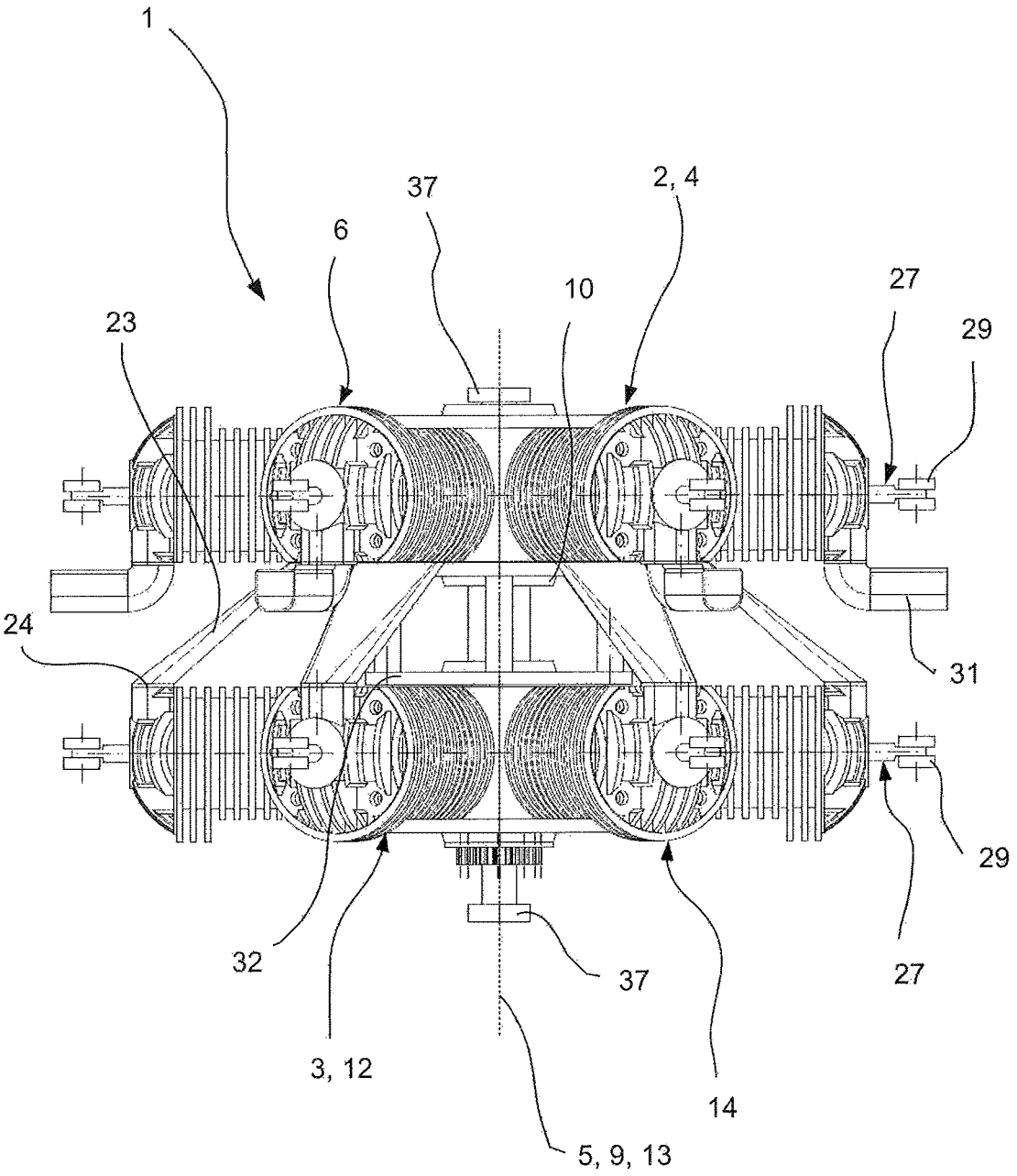
FIG. 2 illustrates a side view of the engine compressor unit according to the invention.
Figure 3:
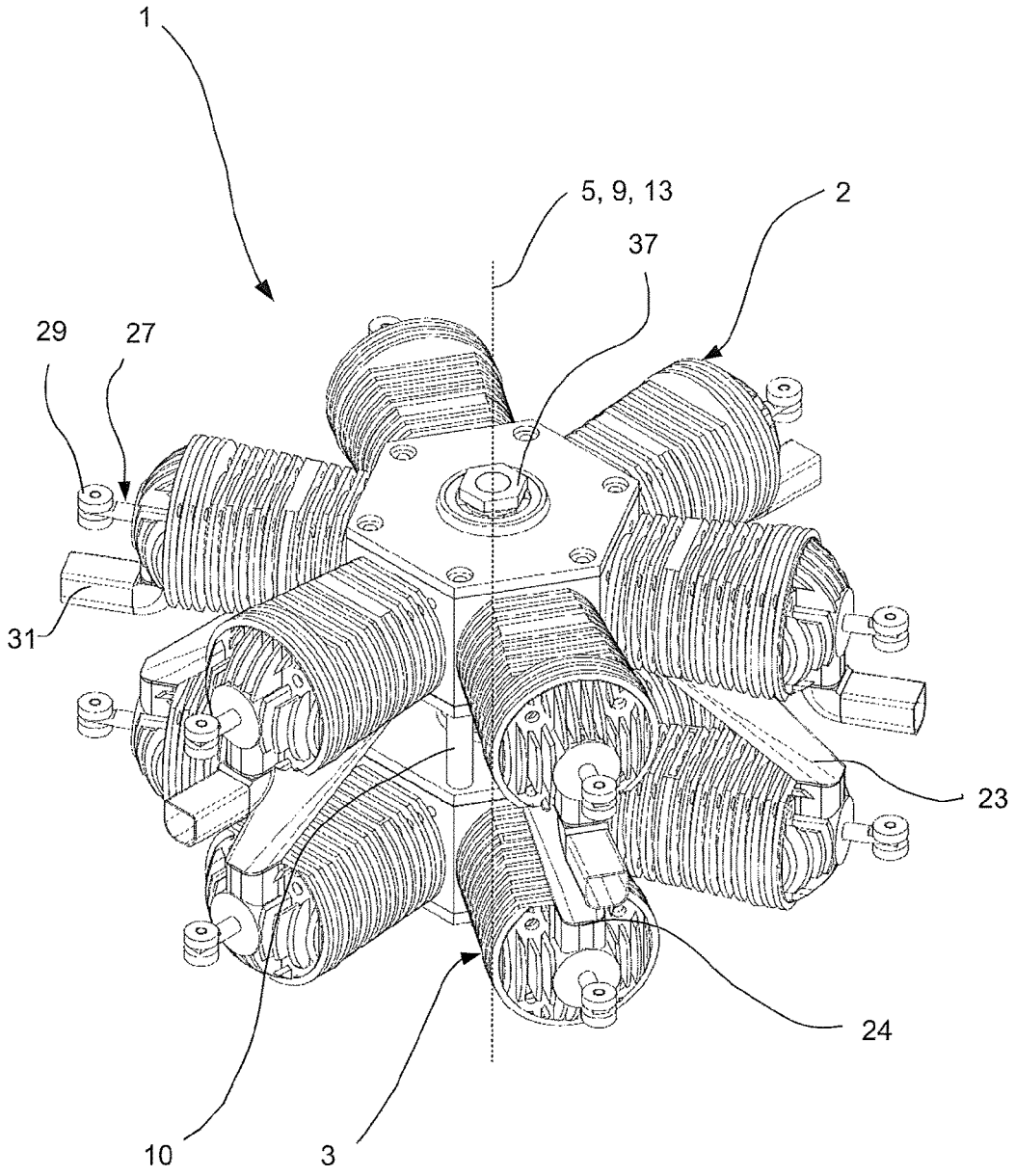
FIG. 3 illustrates an isometric view of the engine compressor unit according to the invention.

As evident in particular from FIG. 2 the rotary engine 2 and the rotary compressor 3 are arranged axially offset along the transmission axis 9. The rotary engine 2 and the rotary compressor 3 are connected for this purpose with one another by a transmission device 10. The connection between the rotary engine 2 and the rotary compressor 3 is thus performed in a torque transferring manner so that the rotation of the rotary engine 2 is transferred directly to the rotary compressor 3. Thus, the transmission arrangement 10 has plural struts which extend parallel to the transmission axis 9 and establish a fixed connection between the rotary engine 2 and the rotary compressor 3. The transmission arrangement 10 is visible quite well in particular in FIG. 3.

In order to operate the engine compressor unit 1 according to the invention the rotary engine 2 is started and thus set in motion. The motion of the rotary engine 2 includes a rotation of the engine ring 4 about the engine axis 5. The circular motion of the engine ring 4 about the engine axis 5 is visible quite well in FIG. 1 based on the circular path 39 that is drawn in dashed lines. Due to the eccentricity 41 between the engine axis 5 and the piston axis 11 also the engine piston 7 rotate. Thus, the stroke movement of the engine pistons 7 forces the rotation of the engine ring 4 since the engine pistons 7 can only escape the axial force imparted upon them by rotating about the piston axis 11 and thus move the engine ring 4 along. Due to the eccentricity 41 the engine pistons 7 continuously perform lift movements in their respective cylinders 6. The engine pistons 7 thus move on a circular path 40 illustrated in FIG. 1, wherein a center of the circular path 40 is offset from a center of the circular path 39 by the eccentricity 41.

The movement of the engine ring 4 is initiated by the combustion of a fuel in the combustion chamber 26 of the cylinder 6. The engine axis 5 and the piston axis 11 remain in place during operation of the rotary engine 2, this means they do not perform a movement. This means that the connecting rod disc 34 at which the individual connecting rods 8 and the master connecting rod 32 are connected also rotates about the piston axis 11. The master connecting rod 32 is connected at a center of the connecting rod disc 34, wherein a connection between the master connecting rod 32 and the connecting rod disc 34 is performed in a force transmitting manner. The remaining connecting rods 8 are respectively pivot ably connected with the connecting rod disc 34. Thus, the remaining connecting rods 8 are statically configured as pendulum rods since they are pivotably connected by piston links 30 at the engine piston 7 as well as pivot ably connected at the connecting rod disc 34.

The rotation generated by the rotary engine 2 is transmitted directly to the rotary compressor 3 due to the transmission device 10. The rotary compressor 3 now functions in a manner that is exactly inverse to the rotary engine 2. This means that no fuel is provided for driving the rotary compressor 3, but a desired substance shall be removable from the rotary compressor 3. This is typically a compressed gas. In order to facilitate this a gas is supplied to the cylinders 14 of the compressor ring 12, wherein the gas is compressed in compressor chambers of the compressor ring 12 by the stroke movements of the compressor pistons 15. The lift movement of the compressor pistons 15 within the cylinders 14 of the compressor ring 12 follows the same principle as the stroke movement of the rotary engine 2. This means also the rotary compressor 3 includes respective connecting rods 8, 32 which cause a movement of the compressor pistons 15 within the cylinder 14 of the rotary compressor 3 during the rotation of the compressor ring 12. Thus, also the rotary compressor 3 includes an eccentrically arranged connecting rod disc 34 which is arranged offset by an eccentricity 41 relative to a compressor axis 13 of the rotary compressor 3.

Figure 4:
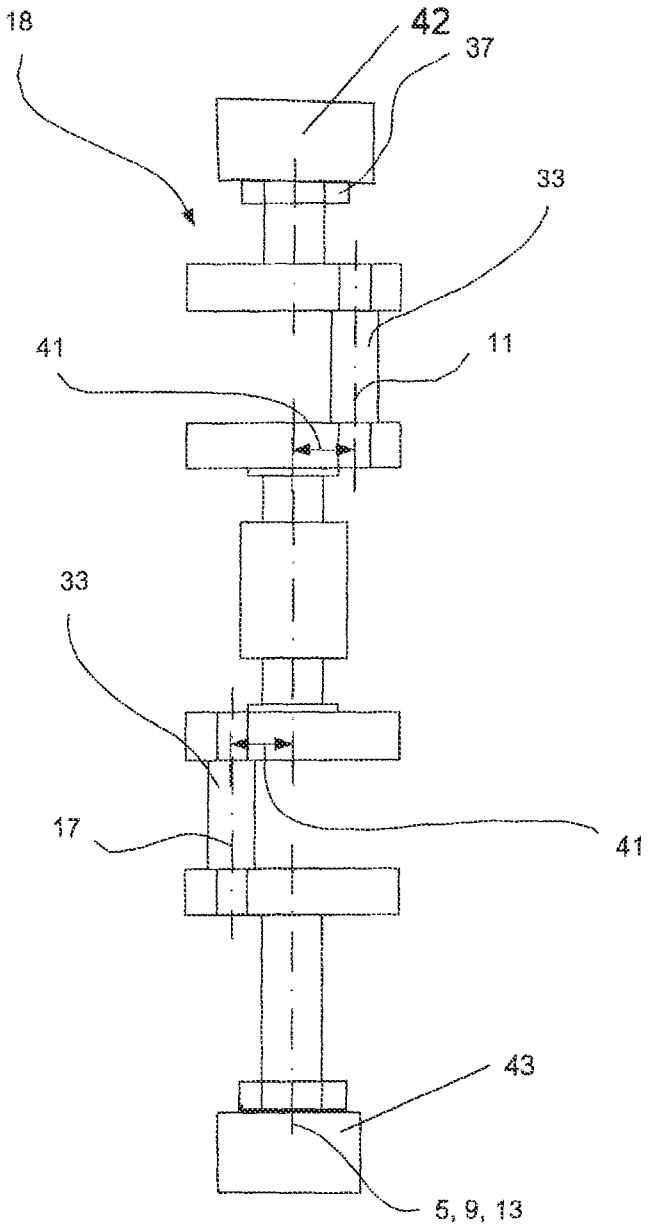
FIG. 4 illustrates a detail of a transmission device of the engine compressor unit according to the invention.
Figure 5:
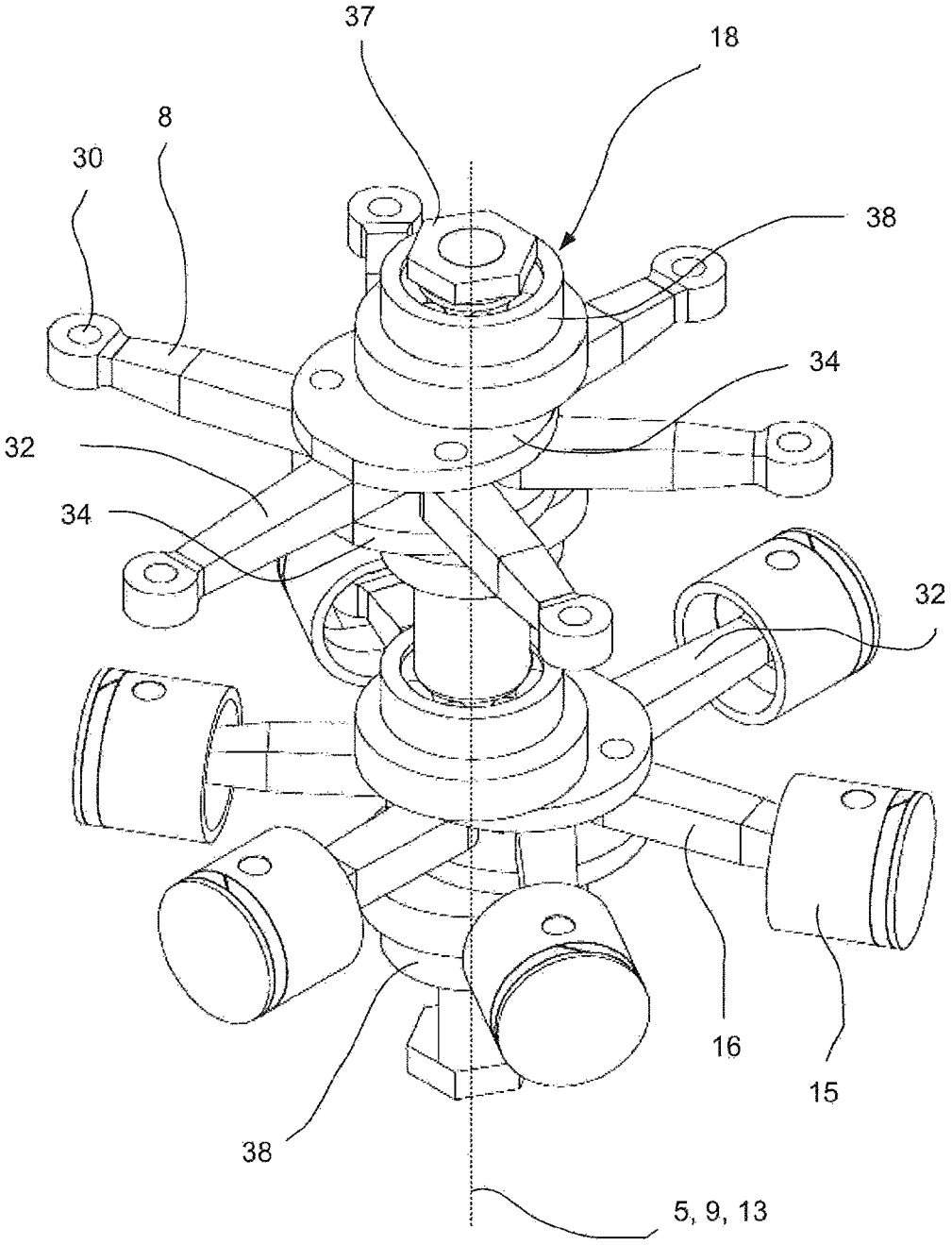
FIG. 5 illustrates a detail of the transmission device together with the connecting rod of the rotary engine and a rotary compressor of the engine compressor unit according to the invention.

In the illustrated embodiment of the engine compressor unit 1 according to the invention the rotary engine 2 and the rotary compressor 3 are arranged along a common transmission axis 9. This means the engine axis 5 and the compressor axis 13 about which the engine ring 4 or the compressor ring 12 rotate coincide. For this configuration it is particularly advantageous to arrange the rotary engine 2 and the rotary compressor 3 on a common carrier shaft. Since the rotary engine 2 as well as the rotary compressor 3 is so to speak a kinematic ally inverted version of a typical piston engine the carrier shaft can also be considered as a crankshaft 18 that remains in place. The crankshaft 18 is visible quite well in FIG. 4 compared to a typical crank shaft of a reciprocating piston engine the crank shaft 18 is stationary during operation of the engine compressor unit 1. This means that the shaft as such as well as its elbows which are configured as pins 33 remain stationary during operation of the engine compressor unit 1. The connecting rod discs 34 of the rotary engine 2 and of the rotary compressor 3 are arranged at the pins 33 and rotate around them. Put differently center axes of the pins 33 coincide with the piston axes 11, 17 of the rotary engine 2 or the rotary compressor 3. A representation of the crank shaft 18 which includes the connecting rods 34 of the rotary engine 2 and of the rotary compressor 3 is derivable from FIG. 5.

The crankshaft 18 is not used for transmitting torques between the rotary engine 2 and the rotary compressor 3. This is exclusively performed by the transmission device 10 that has been described supra. The shoulders of the crank shaft 18, this means the pins 33 are arranged offset relative to the transmission axis 9. As a consequence the engine piston 7 and the compressor pistons 15 are in their respective upper reversal position or lower reversal position at different points in time during operation of the engine compressor unit 1. In the illustrated embodiment the pins 33 of the crankshaft 18 are arranged directly opposite to the transmission axis 9 so that the corresponding compressor piston 15 is provided precisely in its lower reversal position when the respective engine piston 7 is in its upper reversal position. It is appreciated that the associated compressor piston 15 is in its upper reversal position when the engine piston 7 is in its lower reversal position.

The arrangement of the engine pistons 7 and the compressor pistons 15 relative to each other has the advantage that the rotary compressor 3 is usable as a supercharger for the rotary engine 2. This is based on the idea that the engine piston 7 is arranged in its lower reversal position and opens gas inlet openings 25 of the cylinder 6 in the associated cylinder 6. Simultaneously the compressor piston 15 of the associated cylinder 14 of the rotary compressor 3 is in its upper reversal position in which gas arranged in the compressor chamber is compressed by a maximum amount. In this position of the compressor piston 15 the gas outlet opening 24 of the cylinder 14 is opened so that the compressed gas can flow through the straight supercharger tube 23 directly from the gas outlet opening 24 to the gas inlet opening 25 of the cylinder 6 of the rotary engine 2. There the compressed gas flows into the combustion chamber 25 of the cylinder 6 and fills it. The subsequent rotation of the engine ring 4 then provides an additional compression of the gas charge including the fuel.

It is conceivable as a matter of principle to provide the rotary engine 2 with a spark plug and to ignite the fuel or the fuel air mix with an ignition spark when the engine piston 7 is in its upper reversal position. Alternatively it is also conceivable to operate the rotary engine 2 with diesel fuel and to cause an ignition of the fuel solely by the temperature and the pressure in the combustion chamber.

In the art there is a particular problem with engines in being able to open and close valves of the respective cylinders reliably and over a long service life. In the rotary engine 2 according to the invention the problem of valve control is solved by a forced control. For this purpose the rotary engine 2 includes a rise 21 on an inner enveloping surface 19 of its engine housing wherein the rise extends in a radial direction relative to the rise 21. The rise 21 is configured so that a radial distance between the engine axis 5 and a peak of the rise is less than a radial distance between the engine axis 5 and the inner enveloping surface 19 of the engine housing outside of the rise 21.

In the illustrated embodiment the rise 21 extends over a partial angle range 20 of a complete revolution, this means 360° of the engine housing. The rise 21 is thus configured continuous so that there is no cross section leap between the inner surface 19 and the rise 21. The rise 21 is furthermore configured asymmetrical wherein a radially measured height of the rise 21 increases continuously from zero to a peak of the rise and then decreases to 0 again in the same way. Put differently the rise 21 includes an "inlet portion".

The configuration of the rise 21 follows the basic principle that a valve arrangement 27 that rotates in the engine housing is forced radially inward through engagement with the rise 21, this means in a direction towards the engine axis 5. This support of the valve arrangement is thus only performed due to the valve arrangement moving along the rise 21. Thus a purely mechanical control of the valve arrangement is provided.

Figure 6:
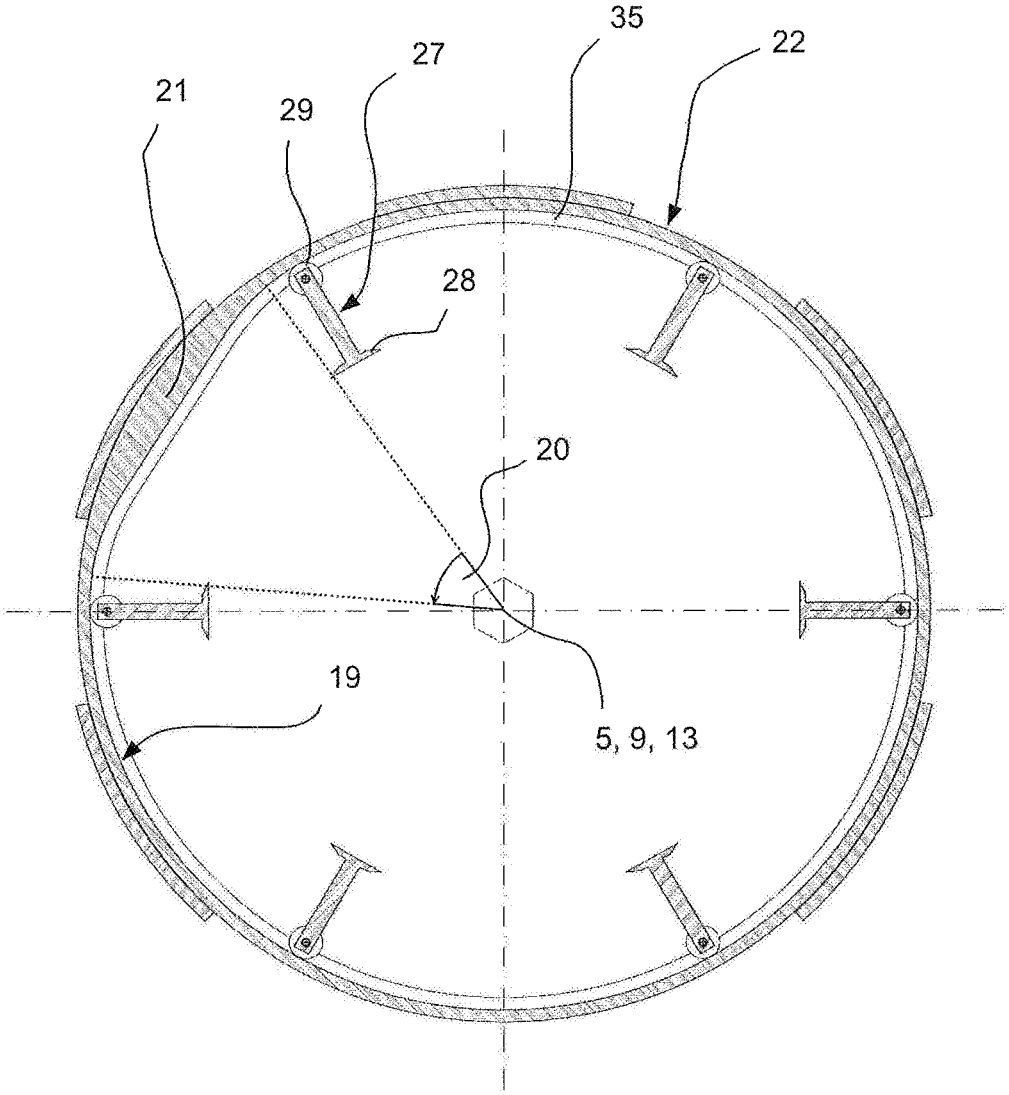
FIG. 6 illustrates a cross section of an engine compressor housing of the engine compressor unit according to the invention.

In the illustrated embodiment of the engine compressor unit 1 according to the invention which includes a rotary engine 2 according to the invention, the inner enveloping surface 19 of the engine compressor housing 22 which envelops the rotary engine and the rotary compressor 3 is provided with a support groove 35 which is configured circumferential and closed in itself at the inner enveloping surface 19 of the engine compressor housing 22. A corresponding running roller 29 is supported in the support groove 35 wherein the running roller is part of a valve arrangement 27. The valve arrangement 27 includes in addition to the running roller 29 a pin shaped shaft and a valve head 28. The valve head 28 is used directly for sealing an associated cylinder 6 of the rotary engine 2. The valve arrangements 27 can be derived in particular from FIG. 1 where they are illustrated engaging the associated engine ring 4. The illustrations according to FIGS. 6 and 7 illustrate the engine compressor housing 22 together with the valve arrangement 27 without illustrating the rotary engine 2 and the rotary compressor 3.

During rotation of the rotary engine 2 the valve arrangement 27 with its running roller 29 is run along the support groove 35 wherein the running roller moves over the rise 21 once with each revolution. Thus, the valve head 28 of a valve arrangement 27 is lifted from its associated valve seat at the associated cylinder 6 once during a revolution of the rotary engine 2 and consequently the combustion chamber is flow connected with an ambient of the cylinder 6. Thus, it is possible to run gases out of the combustion chamber 26 of the cylinder 6. Advantageously an exhaust pipe 31 is arranged at an upper valve opening of each cylinder 6 of the engine ring 4 so that exhaust gases are let out in a controlled manner.

Closing the valve, this means pressing the valve head 28 onto its associated valve seat is performed after moving over the rise 21 self-acting solely due to the prevailing centrifugal forces. A mechanical reset for example by a spring element is not required. Put differently the valve arrangement 27 is supported during its rotation in the engine compressor housing 22 by the centrifugal force with its running roller 29 in the support groove 35 and only when moving over the rise 21 the valve arrangement is forced radially inward in a direction of the engine axis 5 which implements the described opening mechanism.

Figure 7:
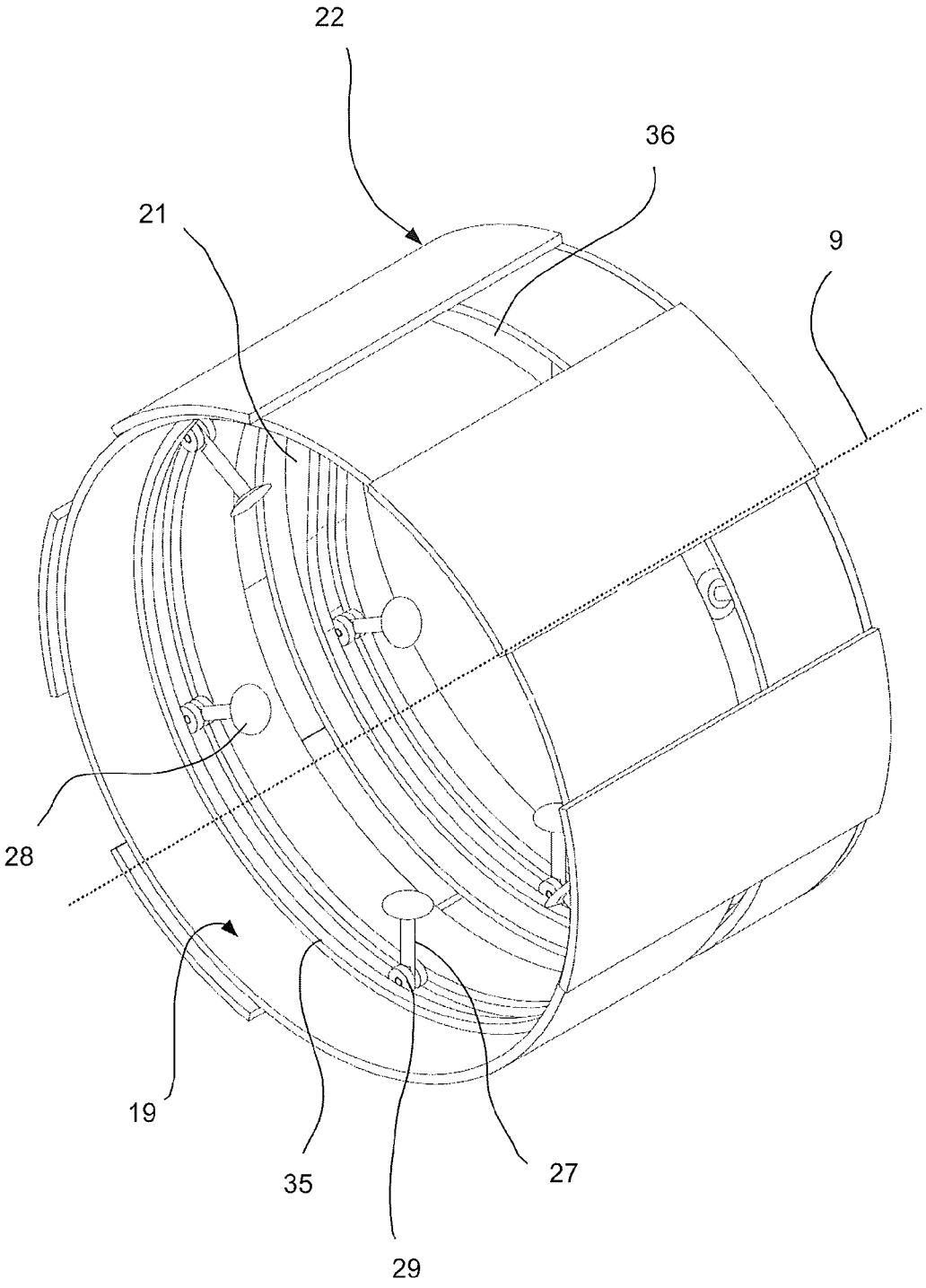
FIG. 7 illustrates an isometric view of the engine compressor housing.

It is evident in particular form FIG. 7 that also the rotary compressor 3 is configured with a respective rise 21. Support groove 35 and the associated valve arrangement 27. Due to the offset arrangement of the piston axes 7, 11 of the rotary engine 2 and the rotary compressor 3 the rises 21 in the engine compressor housing 22 are arranged offset according to the angle offset of the piston axes 7, 11. In this embodiment the rises 21 are arranged opposite to each other relative to the transmission axis 9 in the engine compressor housing 22. The control of the valve arrangement 27 of the rotary compressor 3 facilitates releasing the gas compressed in the respective compressor chamber and thus its outflow from the gas outlet opening 24 into the supercharger tube 23.

In order to let out the exhaust gases through the exhaust pipes 31 the engine compressor housing 22 includes openings 36 that are positioned accordingly and which are distributed over a circumference of the engine compressor housing 22 according to FIG. 7. The crankshaft 18 of the engine compressor unit 1 is fixated by a form locking element 37 in opposite face walls of the engine compressor housing 22 and supported torque proof. The form locking has the effect that the crank shaft 18 is fixated at the engine compressor housing 22 and does not perform a rotation about the transmission axis 9.

In the illustrated embodiment of an engine compressor unit 1 the rotary compressor 3 is exclusively used for supercharging the rotary engine 2. It is appreciated that the rotary compressor 3 is not required for operating the rotary engine 2 but very, advantageous. The axial arrangement of rotary machines along a common axis has the essential advantage that it is conceivable to combine additionally rotary machines with the illustrated engine compressor unit or for example with an isolated rotary engine 2. Thus, it is for example conceivable to provide torque transfer from the illustrated engine compressor unit 1 onto another rotary compressor by gears so that the additional rotary compressor can be operated in analogy to the described rotary compressor 3. It is conceivable for example that an additional rotary compressor of this type operates as a compressor in an otherwise typical compression refrigeration machine 43. This means put differently that the engine compressor unit 1 can be used as a drive element for an air conditioner. As described supra the engine compressor unit can be used to drive a generator unit 42.

In a combination of plural rotary machines on a common axis it can be particularly advantageous when a torque transferring engagement of the respective rotary engine or of plural rotary engines that are coupled with each other and the associated rotary compressor is configured optionally activatable and deactivatable. This can be performed for example by a clutch so that a user of the respective engine compressor unit can activate or deactivate one or plural rotary compressors at will. It is also conceivable to provide plural rotary engines wherein one or plural additional rotary engines are switched on in addition to the first rotary engine as a function of power requirement.

The features presented in the instant embodiment of the rotary engine 2 and of the entire engine compressor unit 1 can be implemented independently from the other features of a respective rotary engine or an engine compressor unit at the discretion of a person skilled in the art. Put differently the individual variants that are combined with one another in the illustrated embodiment do not depend from each other.

REFERENCE NUMERALS AND DESIGNATIONS

1 engine compressor unit
2 rotary engine
3 rotary compressor
4 engine ring
5 engine axis
6 cylinder
7 engine piston
8 connecting rod
9 transmission axis
10 transmission arrangement
11 piston axis
12 compressor ring
13 compressor axis
14 cylinder
15 compressor piston
16 connecting rod
17 piston axis
18 crank shaft
19 inner enveloping surface
20 partial angle range
21 rise
22 engine compressor housing
23 supercharger tube
24 gas outlet opening
25 gas inlet opening
26 combustion chamber
27 valve arrangement
28 valve head
29 running roller
30 piston link
31 exhaust pipe
32 master connecting rod
33 pin
34 connecting rod disc
35 support groove

36 opening
37 form locking element
38 roller bearing
39 circular path
40 circular path
41 eccentricity
42 generator unit
43 compression refrigeration machine

What is claimed is:

1. An engine compressor unit, comprising:

at least one rotary engine; and at least one rotary compressor for compressing at least one gaseous fluid; the at least one rotary engine including an engine housing including at least one engine ring that is rotatably supported in the engine housing about an engine axis;

at least one engine cylinder that is arranged in the engine ring, wherein a respective engine piston is arranged in the at least one engine cylinder so that the respective engine piston defines a combustion chamber of the at least one engine cylinder together with a wall of the at least one engine cylinder, wherein the respective engine piston is supported in the at least one engine cylinder by an engine connecting rod so that the respective engine piston is movable in the at least one engine cylinder in a linear manner;

at least one engine piston axis about which the respective engine piston is rotatable so that the respective engine piston moves on a circular path during an operation of the at least one rotary engine, wherein the at least one engine piston axis is oriented parallel to the engine axis and arranged offset from the engine axis so that the respective engine piston performs a cyclic up and down movement within the at least one engine cylinder during a rotation of the at least one engine ring about the engine axis, the at least one rotary compressor, including a compressor housing including at least one compressor ring that is rotatably supported in the compressor housing about a compressor axis, at least one compressor cylinder that is arranged in the at least one compressor ring, wherein a respective compressor piston is arranged in the at least one compressor cylinder so that the respective compressor piston defines a compression chamber of the at least one compressor cylinder together with a wall of the at least one compressor cylinder, wherein the respective compressor piston is supported in the at least one compressor cylinder by a compressor connecting rod so that the respective compressor piston is movable in the at least one compressor cylinder in a linear manner;

at least one compressor piston axis about which the respective compressor piston is rotatable so that the respective compressor piston moves on a circular path during an operation of the at least one rotary compressor; and at least one supercharger tube that is configured to provide flow connection between a gas outlet opening of the rotary compressor and a gas inlet opening of the at least one rotary engine that is controlled by the respective engine piston, so that at least a portion of a gas that is compressed by the at least one rotary compressor is fed or feedable to the combustion chamber of the at least one engine cylinder by the at least one supercharger tube, wherein the compressor piston axis is oriented parallel to the compressor axis and arranged offset from the compressor axis so that the respective compressor piston performs a cyclic up and down movement within the at least one compressor cylinder during a rotation of the at least one compressor ring about the compressor axis, wherein the at least one rotary engine and the at least one rotary compressor are coupleable with each other by a transmission arrangement so that torque is transferable between the at least one rotary engine and the at least one rotary compressor, wherein the engine housing and the compressor housing each include a radially inward extending rise on an inner enveloping surface, and wherein each rise extends over a partial angular range of the engine housing and the compressor housing respectively, wherein the at least one engine cylinder includes a respective first valve arrangement that is configured to let the gas out of the combustion chamber during an operation of the at least one rotary engine, wherein the respective first valve arrangement engages the engine housing at least over a partial angle range of a revolution of the at least one engine cylinder about the engine axis, wherein the engagement forces a respective first valve element of the respective first valve arrangement from a first valve seat, so that a flow connection is opened or openable between the combustion chamber of the at least one engine cylinder and an ambient, wherein the at least one compressor cylinder includes a respective second valve arrangement that is configured to let the gas out of the compression chamber during operation of the at least one rotary compressor, wherein the respective second valve arrangement engages the compressor housing at least over a partial angle range of a revolution of the at cylinder about the compressor axis, and wherein the engagement forces a respective second valve element of the respective second valve arrangement from a second valve seat, so that a flow connection is opened or openable between the compression chamber of the at least one compressor cylinder and the at least one supercharger tube.

2. The engine compressor unit according to claim 1, wherein a transmission axis of the transmission arrangement is provided, wherein the transmission arrangement rotates about the transmission axis during operation of the engine compressor unit, and wherein the transmission axis coincides with the engine axis and the compressor axis.

3. The engine compressor unit according to claim 1, wherein the transmission arrangement is coupleable so that a torque transmission between the at least one rotary engine and the at least one rotary compressor is activatable and deactivatable.

4. The engine compressor unit according to claim wherein the at least one rotary engine or the at least one rotary compressor are supported by a common stationary crankshaft, and wherein a shaft axis of the common crankshaft and the piston axis of the at least one rotary engine or the piston axis of the at least one rotary compressor are arranged parallel to one another and offset from one another.

5. The engine compressor unit according to claim 4, wherein the at least one rotary engine and the at least one rotary compressor are supported axially offset from each other along the common stationary crankshaft, wherein the piston axis of the at least one rotary engine and the piston axis of the at least one rotary compressor are arranged parallel to each other and offset from each other at the common stationary crankshaft, and wherein the piston axis of the at least one rotary engine and the piston axis of the at least one rotary compressor are arranged in a plane that is orthogonal to the shaft axis of the common stationary crankshaft and are arranged opposite to one another relative to the shaft axis of the common stationary crankshaft.

6. The engine compressor unit according to claim 1, wherein the at least one rotary engine and the at feast one rotary compressor are combined in a common engine compressor housing.

7. The engine compressor unit according to claim 1, further comprising:

a generator unit configured to convert mechanical energy into electrical energy or vice versa, wherein the generator unit includes at least one generator housing in which a rotor is rotatably supported about a generator shaft of the generator housing, and wherein the generator shaft is at least temporarily coupleable with the transmission arrangement in a force transferring manner.

8. The engine compressor unit according to claim 1, wherein the rise of the engine housing extends at least over a partial angle range of a complete revolution of the at least one engine cylinder about the engine axis on an inner enveloping surface of the engine housing, and wherein a radial distance between a peak of the rise of the engine housing and the engine axis is less than a radial distance between the inner enveloping surface of the engine housing and the engine axis.

9. The engine compressor unit according to claim 8, further comprising: a support groove which is circumferentially arranged and closed at the inner enveloping surface of the engine housing and which cooperates with the rise of the engine housing.

10. The engine compressor unit according to claim 9, wherein the at least one valve arrangement includes a running roller or a support slide through which the at least one valve arrangement cooperates with the support groove.

11. A compression refrigeration machine driven by the engine compressor unit according to claim 1.

* * * * *